US007234484B2

(12) United States Patent
Laws et al.

(10) Patent No.: US 7,234,484 B2
(45) Date of Patent: Jun. 26, 2007

(54) PRESSURE TANK APPARATUS AND METHOD

(76) Inventors: Ruth Laws, 620 W. Valley Rd., Strafford-Wayne, PA (US) 19087; George E. Hitchens, 620 W. Valley Rd., Strafford-Wayne, PA (US) 19087

( * ) Notice: Subject to any disclaimer, the term of this patent is extended or adjusted under 35 U.S.C. 154(b) by 294 days.

(21) Appl. No.: 10/933,318

(22) Filed: Sep. 3, 2004

(65) Prior Publication Data

US 2006/0048817 A1 Mar. 9, 2006

(51) Int. Cl.
*B67D 5/54* (2006.01)

(52) U.S. Cl. ..... 137/209; 222/61

(58) Field of Classification Search ..... 137/209, 137/206, 557; 222/61
See application file for complete search history.

(56) References Cited

U.S. PATENT DOCUMENTS 1,090,244 A * 3/1914 Staples ..... 137/209
2,083,965 A * 6/1937 Schulz ..... 222/61
2,909,187 A * 10/1959 Gillooly, Sr. ..... 137/209
3,331,328 A * 7/1967 Smith et al. ..... 137/209
4,239,054 A * 12/1980 Van Rijn ..... 137/209
5,205,316 A * 4/1993 Pruett ..... 137/209
5,218,986 A * 6/1993 Farwell ..... 137/14
5,635,394 A * 6/1997 Horn ..... 435/266
5,868,280 A * 2/1999 Schroeder ..... 222/64
6,167,845 B1 * 1/2001 Decker, Sr. ..... 122/40
6,415,816 B1 * 7/2002 Beckey et al. ..... 137/526
6,481,456 B1 * 11/2002 Falkner ..... 137/206
2002/0189173 A1 * 12/2002 Staschik ..... 52/79.1

* cited by examiner

*Primary Examiner*—Eric Keasel
*Assistant Examiner*—Craig M. Schneider
(74) *Attorney, Agent, or Firm*—Baker & Hostetler LLP

(57) ABSTRACT

A pressure tank apparatus for use with a plumbing system of the like. The pressure tank apparatus includes a liquid storage vessel having a first end and a second end along with a curved side wall that extends between the first and second ends. The pressure tank apparatus also includes an inlet conduit connected to the liquid storage vessel along with an outlet conduit connected to the liquid storage vessel. The pressure tank apparatus also includes a valve cap connected to the liquid storage vessel and a first cut-off valve connected to the inlet conduit along with a second cut-off valve connected to the outlet conduit.

23 Claims, 3 Drawing Sheets

PRESSURE TANK APPARATUS AND METHOD

FIELD OF THE INVENTION

This invention relates generally to an apparatus and method for water pressure systems for households, for example. More particularly, the present invention relates, for example, to an improved pressure tank apparatus and method for use with water wells and household plumbing systems and the like.

BACKGROUND OF THE INVENTION

The plumbing systems of households sometimes employ water pressure systems or the like to help mitigate the effects of low water pressure or loss of water pressure. These water pressure systems are typically established by first drilling a hole in the ground in search of water from a water bearing aquifer. Once water is reached, a well housing or casing is inserted into the hole to preserve the sides of the well. Next, a submersible pump is inserted into the well below the water level to pump the water from the aquifer. These types of water pressure systems also typically include a drop pipe where one end of the drop pipe is attached to the submersible pump to draw water out of the well, while the other end is attached to a pitless adapter. The pitless adapter is usually attached to a discharge pipe which carries water to a pressure tank or the like, located in the household or another building. Water from the pressure tank is then distributed throughout the household for use.

One of the functions of the pressure tank is to retain a reserve supply of water under pressure. A pressure is usually employed by the tank that helps to maintain the water pressure in the tank between a desired minimum and maximum value. A pressure switch is typically utilized, which activates the submersible pump to pump water into the tank when the water pressure is in the tank drops below the desired minimum value. As water is pumped into the tank to replenish the tank, the pressure in the tank increases or builds to the desired maximum value. Once the maximum pressure value has been obtained, the pressure switch switches the pump off stopping the flow of water into the tank. The water is usually stored in the pressure tank until it is needed. As water is withdrawn form the tank, the pressure once again decreases. As water is continually withdrawn, the pressure within the tank continues to decrease and upon reaching the set minimum pressure, the pressure switch automatically activates the pump to fill the tank.

Pressure tanks are usually large in size and are therefore oftentimes utilized in above ground plumbing installations. Typically, pressure tanks are installed in the basement of a house or building, or in a separate building near the house or building. This is especially true in cold climate areas, because adverse weather conditions effect the reliability of the pressure tank.

The aforementioned pressure tanks have drawbacks, however. The pressure tanks are very large in size and therefore have very large footprints. Due to their large footprints, the pressure tanks oftentimes occupy valuable space in the home. Furthermore, the pressure tanks can be expensive to install and typically employ various moving parts that can wear after extended use.

Accordingly, there is a need in the art to provide a water pressure system that includes an inexpensive pressure tank having a small footprint. It is further desirable to provide a water pressure system that includes a pressure tank apparatus that employs minimal moving parts.

SUMMARY OF THE INVENTION

The foregoing needs are met, to a great extent, by the present invention, wherein aspects of a pressure tank apparatus and method are provided.

In accordance with an embodiment of the present invention, a pressure tank apparatus is provided having a liquid storage vessel. The liquid storage vessel includes first and second ends along with a curved side wall that extends between the first and second ends. The pressure tank apparatus also includes an inlet conduit and a first outlet conduit each connected to the liquid storage vessel. The pressure tank further includes a valve cap and first and second cut-off valves.

In accordance with another embodiment of the present invention, a pressure tank apparatus is provided having liquid storage vessel. The liquid storage vessel includes first and second ends, first and second side walls and first and second end walls. The pressure tank apparatus also includes an inlet conduit and a first outlet conduit each connected to the liquid storage vessel. The pressure tank further includes a valve cap and first and second cut-off valves.

In accordance with yet another embodiment of the present invention, a water pressure system is provided, comprising: a pump that pumps water from a water bearing aquifer; a pressure tank apparatus connected to said pump, wherein said pressure tank comprises: a liquid storage vessel, wherein said liquid storage vessel comprises: a first end; a second end that opposes said first end; and a curved side wall that extends between said first end and said second end, wherein said curved side wall encircles the longitudinal axis to define an inner chamber; an inlet conduit connected to said liquid storage vessel and said pump; a first outlet conduit connected to said liquid storage vessel; a valve cap connected said liquid vessel; a first cut-off valve connected to said inlet conduit, wherein said first cut-off valve controls the liquid flow into said inner chamber; and a second cut-off valve connected to said first outlet conduit, wherein said second cut-off valve controls the flow of liquid out of said inner chamber.

In accordance with still another embodiment of the present invention, a method for pressurizing a liquid is provide, comprising the steps of: pumping a liquid into a pressure tank apparatus, wherein the tank apparatus comprises: a liquid storage vessel, wherein the liquid storage vessel comprises: a first end; a second end that opposes the first end; and a curved side wall that extends between the first end and the second end, wherein the curved side wall encircles the longitudinal axis to define an inner chamber; an inlet conduit connected to the liquid storage vessel; an outlet conduit connected to the liquid storage vessel; a valve cap connected the liquid vessel; a first cut-off valve connected to the inlet conduit, wherein the first cut-off valve controls the liquid flow into the inner chamber; and a second cut-off valve connected to the first outlet conduit, wherein the second cut-off valve controls the flow of liquid out of the inner chamber; compressing a quantity of air retained within the vessel; generating a pressure equilibrium between the water and the quantity of air within the vessel.

In accordance with a further embodiment of the present invention, a pressure tank apparatus is provided, comprising: means for pumping a liquid into a pressure tank apparatus, wherein the tank apparatus comprises: a liquid storage vessel, wherein the liquid storage vessel comprises: a first end; a second end that opposes the first end; and a curved side wall that extends between the first end and the second end, wherein the curved side wall encircles the longitudinal axis to define an inner chamber; an inlet conduit connected to the liquid storage vessel; an outlet conduit connected to the liquid storage vessel; a valve cap connected the liquid vessel; a first cut-off valve connected to the inlet conduit, wherein the first cut-off valve controls the liquid flow into the inner chamber; and a second cut-off valve connected to the first outlet conduit, wherein the second cut-off valve controls the flow of liquid out of the inner chamber; means for compressing a quantity of air retained within the vessel; means for generating a pressure equilibrium between the water and the quantity of air within the vessel.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
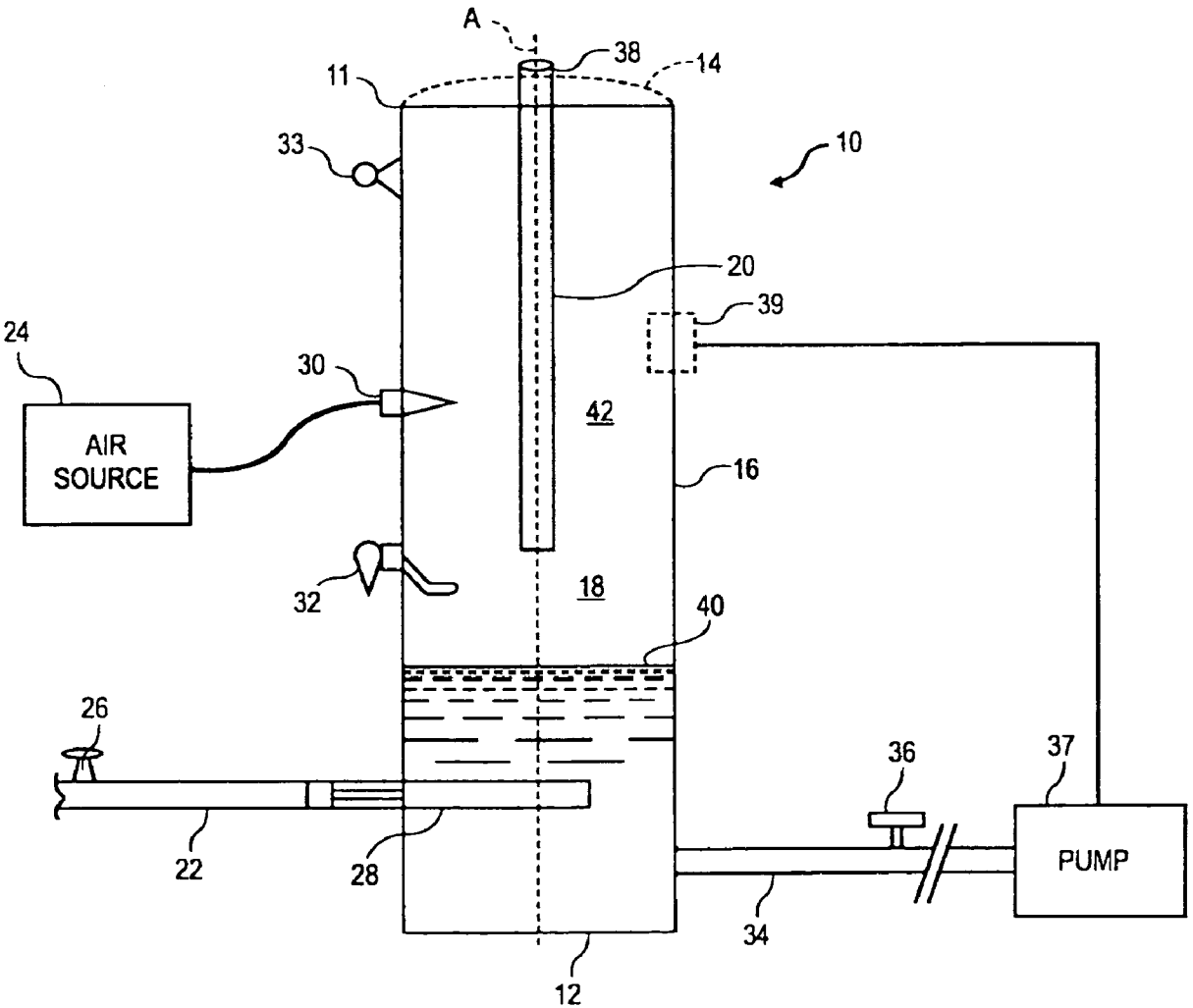
FIG. 1 is a side sectional view of a pressure tank apparatus in accordance with an embodiment of the present invention.

Various preferred embodiments of the present invention provide for a liquid pressure tank apparatus and method. In some arrangements, the pressure tank apparatus may be utilized with water pressure systems or plumbing systems for homes or households, for example. It should be understood, however, that the present invention is not limited in its application to household water pressure systems, but, for example, with other liquid flow systems that require the flow of liquid under pressure. Preferred embodiments of the invention will now be further described wither reference to the drawing figures, in which like reference numerals refer to like parts throughout.

Referring now to FIG. 1, a pressure tank apparatus, generally designated 10, is depicted in accordance with an embodiment of the present invention. The pressure tank apparatus 10 includes a vessel, generally designated 11, having a longitudinal axis A. The vessel 11 of the pressure tank apparatus 10 includes a bottom wall 12 that opposes a top wall 14, along with a curved side wall that encircles the longitudinal axis A. As illustrated in FIG. 1, the curved side wall 16 is connected to both the bottom wall 12 and the top wall 14 and extends there between to define a sealed inner space or chamber 18 of the pressure tank 10.

The pressure tank apparatus 10 further includes a first outlet conduit 20 and a second outlet conduit 22. The first outlet conduit 20 is preferably positioned on the top wall 14 of the apparatus 10, wherein the first outlet conduit 20 extends through the top wall 14 into the chamber 18. As illustrated in FIG. 1, the first outlet conduit 20 extends through the top wall 14 into the chamber 18, at least partially all the way to the bottom wall 12. The first inlet conduit 20 preferably has a diameter equal to approximately 0.75 inches. The second outlet conduit 22 is positioned on the side wall 16 preferably at an axial location near the bottom wall 12 where it extends through the wall and into the chamber 18. The second outlet conduit 22 includes a first conduit section having a diameter equal to approximately 0.75 inches. As illustrated in FIG. 1, the first conduit section extends from the side wall 16 to a cutoff valve 26. The second outlet conduit 22 also includes a second conduit section 28 also having diameter equal to approximately 0.75 inches. Also as illustrated in FIG. 1, the second conduit section 28 extends from the side wall 16 into the chamber 18 approximately 10 inches.

As depicted in FIG. 1, the pressure tank apparatus 10 additionally includes an air valve cap 30 and a air control valve 32 each mounted to the side wall 16 along with a pressure gauge 33. The pressure tank apparatus 10 also includes a water inlet conduit 34 connected to the side wall 16, that provides water to the chamber 18 of the pressure tank apparatus 10. The inlet conduit 34 includes a cut off valve 36 and is connected to a water source, such as a well or municipal water supply and a water pump 37.

The water pump 37 may be any water pump that is capable of propelling or pumping water from a well, water receptacle, municipal water supply or the like, into the chamber 18 of the vessel 11, compressing the air contained therein. However, in one embodiment of the present invention, the pump 37 is a jet pump or the like, having power equal to approximately one horsepower to approximately one and one half horsepower, for example.

The vessel 11 is preferably constructed from a plastic material, for example, polyvinylchloride (PVC), or any other suitable plastic like material, wherein the side wall 16, top wall 14 and bottom wall 12 are integral with one another. Alternatively, the walls, bottom, top and side, 12, 14, 16, respectively, may be connected or attached to one another using mechanical attachment means such as a bracket or screw, or the walls 12, 14, 16 may be connected to one another using glue or by melting methods. In the embodiment depicted, the vessel 11 holds approximately 80 gallons of water. Depending upon the plumbing system with which the pressure tank apparatus 10 is used, larger or smaller vessels may be employed, for example, the vessel 11 can range in size from approximately 40 gallons to approximately 80 gallons.

The vessel 11 may alternatively be constructed from a metal material such as galvanized steel, aluminum and/or stainless steel. In theses embodiments, the bottom wall 12, top wall 14 and side wall 16 once again may be integral with one another, or alternatively, they may connected to one another via weld attachment, for example.

The first and second outlet conduits 20, 22 are preferably pipes or piping constructed from a metal material such as galvanized steel and/or stainless steel. As illustrated in FIG. 1, the first outlet conduit 20 extends approximate 20 inches into the chamber 18, generally parallel to the longitudinal axis A while the second inlet conduit extends approximately 10 inches into the chamber 18, generally perpendicular or normal to the longitudinal axis A. As previously discussed, the outlet conduits 20, 22 each have a diameter equal to approximately 0.75 inches. The diameters of the outlet conduits 20, 22 may vary depending upon the plumbing system with which the pressure tank apparatus 10 uses and/or the size of the vessel utilized. For example, the conduits 20, 22 may have diameters that range from approximately 0.25 inches to approximately 2.25 inches. Moreover, the first outlet conduit 20 may have a diameter that differs from the second outlet conduit 22.

Alternative embodiments encompassed by the present invention may include conduit outlets 20, 22 manufactured from plastic materials such as PVC. Furthermore, alternative embodiments may include outlet lengths wherein the outlet conduits 20, 22 extend into the chamber 18, distances greater than, or less than, the 20 inches and 10 inches lengths into the vessel 11 as depicted. For example if the vessel 11 size is greater than 80 gallons, these lengths may be increased, and for example, if the vessel size is less than 80 gallons, these lengths may be decreased. Moreover, alternative embodiments encompassed by the present invention may include outlet conduits 20, 22 of varying lengths such as outlet conduits with lengths ranging from approximately 5 inches to approximately 65 inches. Also, the alternative embodiments of the present invention may include pressure tank apparatuses 10 having outlet conduits 20, 22 positioned at varying locations on the vessel 11 and positioned at varying angles to longitudinal axis A. Alternative embodiments of the pressure tank apparatus 10 also include a plurality of outlet conduits or, to the contrary, single outlet conduit.

The pressure apparatus may also include a pressure switch 39 coupled to the vessel 11 that can assist to maintain the air pressure in the tank between a maximum and a minimum value, however a pressure switch 39 is not required to operate the pressure tank apparatus 10. The pressure switch 39 can be connected to, and communicate with, the pressure gauge 33, or alternatively, the pressure switch may include an internal pressure sensor or gauge. The pressure switch 39 activates the pump 37 to pump water into the vessel 11 when the air pressure in the vessel 11 drops below the minimum value.

As depicted in FIG. 1, the pressure tank apparatus 10 also includes the water inlet conduit 34 that is connected to a water source such as a water well and/or a municipal water line and the water pump 37. The inlet conduit 34 has a diameter equal to approximately 0.75 inches. As previously discussed, the water inlet 34 is connected to the cut-off valve 36 which can function to control the flow of water into the chamber 18 of the pressure tank apparatus 10. Like the outlet conduits 20, 22, the inlet conduit 34 is preferably constructed from metal materials such as stainless steel, galvanized steel or the like. Alternatively, the inlet conduit 34 may be constructed from plastic materials such as PVC. And like the outlet conduits 20, 22, the inlet conduit may have a diameter that ranges from approximately 0.25 inches to approximately 2.25 inches, depending upon the system with which the apparatus 10 is used.

The pressure gauge 33 of the apparatus 10 is a standard pressure gauge that functions to measure and indicate the amount of air pressure, in terms of pounds per square inch (psi), within the chamber 18 during operation of the pressure tank apparatus 10. During operation, the pressure tank apparatus 10 preferably has standard air pressure within the chamber 18 equal to approximately 25 psi to approximately 70 psi. More preferably, the pressure tank apparatus 10 operates at a standard air pressure equal to approximately 35 psi to approximately 65 psi, during operation. Even more preferably, the pressure tank apparatus 10 operates at a standard air pressure equal to approximately 60 psi during operation. The aforementioned air pressure may be maintained and controlled by use of the valve cap 30 and the air control valve 32. Whereas the valve cap 30 allows one to add air pressure to the vessel 11, for example by attaching a compressed air source 24 thereto the air control valve 32 regulates or controls the air pressure by releasing air from the chamber 18 when it exceeds a maximum, predetermined value.

The valve cap 30 allows for the compressed air source 24 such as an air pump, air compressor or the like to be connected to the vessel 11 of the pressure tank apparatus 10 and add air pressure to the chamber 18 in instances where the air pressure has decreased or simply when more pressure is desired, for example. As previously mentioned, the air control valve 32 functions to control or regulate the air pressure within the chamber 18 during operation of the pressure tank apparatus 10. The air control valve 32 may be a manual control valve wherein it is manually operated to release air pressure from the chamber 18. Alternatively, the air control valve 32 may be any automatic control valve, wherein the valve 32 may be preprogrammed to release air from the chamber 18 once the air pressure within the chamber 18 reaches a desired maximum level.

During operation of the pressure tank apparatus 10, water is pumped from a water source such as a well or municipal water supply by the pump 37 at a constant rate, through the cut-off valve 36 and inlet conduit 34, into the chamber 18. As the water is pumped through the inlet conduit 34, the water level 40 rises, compressing the air, creating a pocket of compressed air, generally designated 42, in the chamber 18. As the liquid level 40 continues to rise, the pressures within the chamber 18 will reach an equilibrium, wherein the air pressure is equal to approximately 40 psi. Once the aforementioned equilibrium is obtained, the water may exit the vessel under pressure through either the first outlet conduit 20 or the via the second outlet conduit 22. In the embodiment depicted, the cut-off valve 26 is open allowing water to flow through the second outlet conduit 22 while the first outlet conduit is closed by a valve or capping means 38, preventing flow through it. Alternatively, both the first outlet conduit 20 and the second outlet conduit 22 may be opened, allowing the pressurized water to flow through both conduits 20, 22. Still yet, in another configuration, the shut-off valve 26 may be close preventing water flow through the second outlet conduit 22, while the first conduit 20 is open, allowing flow therethrough.

In the embodiment depicted, the water may flow through the vessel 11 at a constant rate, wherein the pump 37 pumps the water at a constant rate and the water level 40 remains relatively constant, and therefore the air pressure remains relatively constant. In these configurations, a pressure switch is not utilized because the water supply contained within the chamber 18 of the vessel is constantly replenished. The water constantly flows from the water supply, through the inlet conduit 34 into the chamber 18 and out either one or both of the outlet conduits 20, 22. Alternatively, the pressure tank apparatus 10 may utilize the pressure switch 39, in these configurations, the vessel 11 holds a reserve supply of water under pressure. However, instead of the constant flow of water through the pressure tank apparatus 10, the pressure switch 39 cycles the pump 37 on and off, in response to fluctuations in air pressure within the chamber 18 of the vessel 11 due to the withdrawal of water from the chamber 18. For example, when water exits the vessel 11 through the outlet conduits 20, 22, the air pressure decreases. Once the pressure decreases to a value below a set minimum value, the pressure switch cycles the pump 37 on, causing the chamber 18 of the vessel 11 to fill and therefore causing the air pressure to rise. Once the pressure reaches a set, acceptable level, the pressure switch cycles the pump 37 off.

Figure 2:
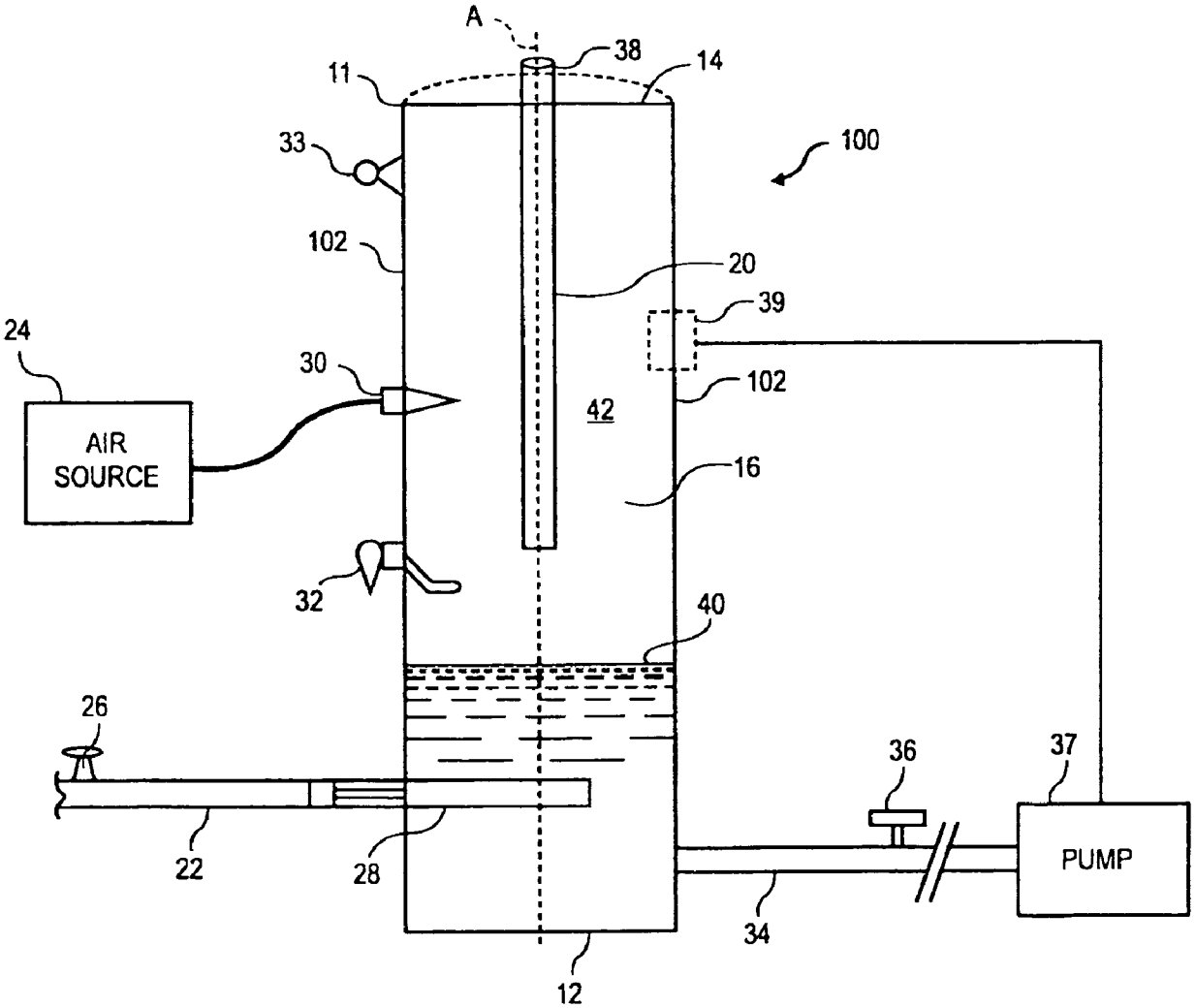
FIG. 2 is a side sectional view of a pressure tank apparatus in accordance with another embodiment of the present invention.

Referring now to FIG. 2, a pressure tank apparatus, generally designated 100, is illustrated in accordance with an alternative embodiment of the present invention. Whereas the embodiment depicted in FIG. 1 is generally cylindrical in geometry having a curved side wall 16, the apparatus 100 illustrated in FIG. 2 has a generally square or rectangular configuration. Instead of a curved sidewall, the apparatus 100 includes four generally planar side walls 102 that are generally similar to one another (only two are depicted) extending between the top wall 14 and the bottom wall 12.

Figure 3:
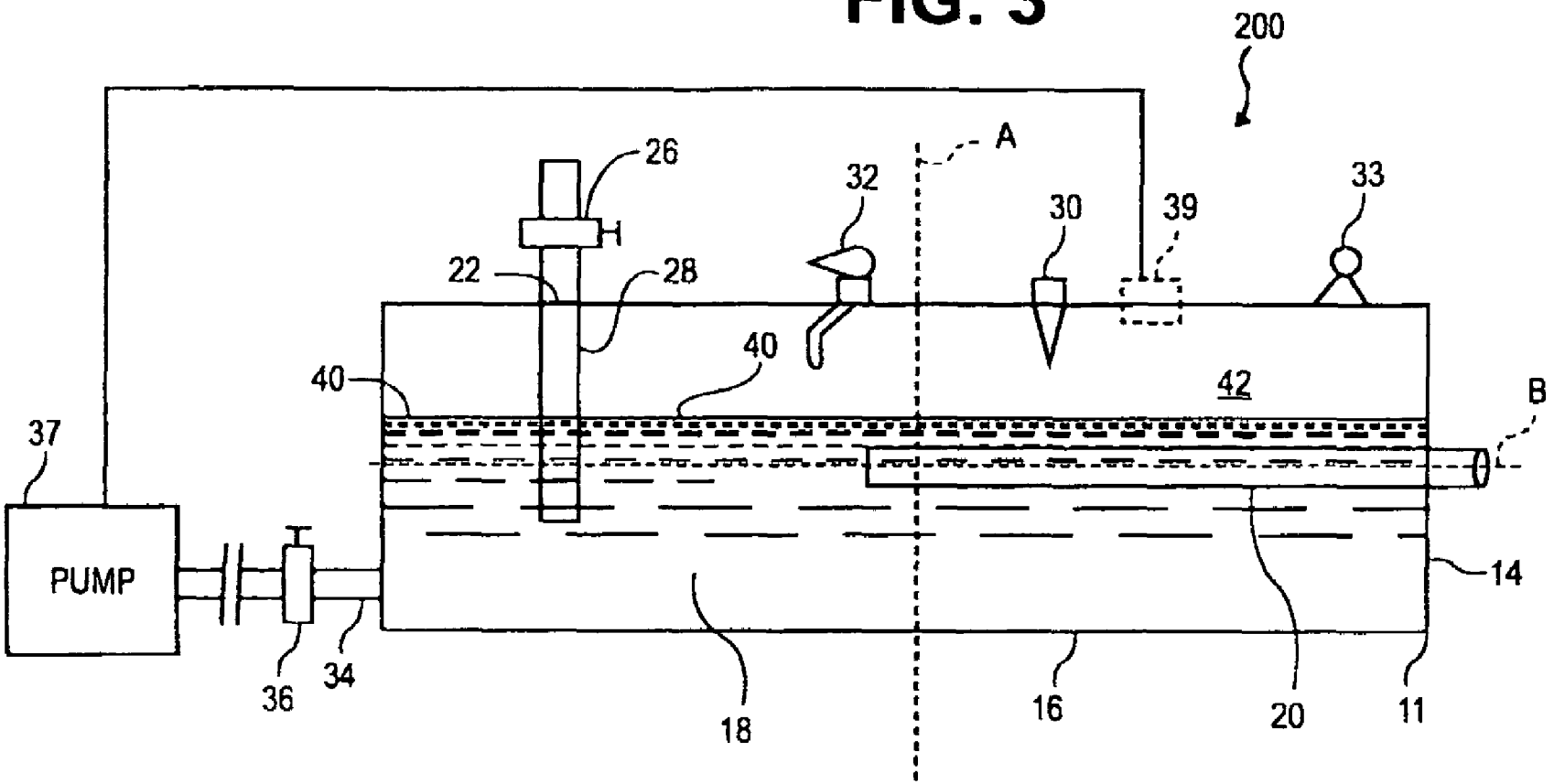
FIG. 3 is a side sectional view of a pressure tank apparatus in accordance with yet another embodiment of the present invention.

Referring now to FIG. 3, a pressure tank apparatus, generally designated 200, is illustrated in accordance with another alternative embodiment of the present invention. Whereas the embodiments illustrated in FIGS. 1 and 2 depict pressure tank embodiments that stand vertically upright, FIG. 3 depicts a horizontal pressure tank apparatus 200. In the embodiment depicted in FIG. 3, the curved side wall 16 encircles a horizontal axis B that is generally normal or perpendicular to the longitudinal axis A.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A pressure tank apparatus having a longitudinal axis, comprising:

a liquid storage vessel, wherein said liquid storage vessel comprises:

a first end;

a second end that opposes said first end; and a curved side wall that extends between said first end and said second end, wherein said curved side wall encircles the longitudinal axis to define an inner chamber;

an inlet conduit connected to said liquid storage vessel, said inlet conduit being disposed at a lower portion of said inner chamber;

a first outlet conduit connected to said liquid storage vessel;

a second outlet conduit connected to said liquid storage vessel and passing through a center of said second end, the second outlet conduit extending along said longitudinal axis to about a midpoint of said longitudinal axis;

an air control valve passing through said curved side wall and disposed between said first outlet conduit and said second outlet conduit, wherein said air control valve releases air from said inner chamber in response a pressure in said inner chamber exceeding a predetermined maximum pressure threshold;

a valve cap connected to said liquid storage vessel;

a compressed air source connected to said valve cap to supply compressed air to said inner chamber;

a first cut-off valve connected to said inlet conduit, wherein said first cut-off valve controls the liquid flow into said inner chamber;

a second cut-off valve connected to said first outlet conduit, wherein said second cut-off valve controls the flow of liquid out of said inner chamber;

a pump connected to said inlet conduit, wherein said pump pumps liquid into said inner chamber under pressure via said inlet in response to being activated; and an air pressure switch configured to sense a pressure in said inner chamber, wherein said air pressure switch is configured to activate the pump in response to the sensed pressure being less than a pre-determined minimum pressure threshold and wherein said air pressure switch is configured to deactivate said pump in response to said sensed pressure exceeding a working pressure threshold.

2. The pressure tank apparatus according to claim 1, further comprising:

an air pressure gauge.

3. The pressure tank apparatus according to claim 1, wherein said first outlet conduit is connected to said curved side wall.

4. The pressure tank apparatus according to claim 1, wherein said first outlet conduit has a diameter equal to approximately 0.25 inches to approximately 2.25 inches and a length equal to approximately 21 inches and wherein said second outlet conduit has a diameter equal to approximately 0.25 inches to approximately 2.25 inches and a length equal to approximately 10 inches.

5. The pressure tank apparatus according to claim 4, wherein the diameter of said first outlet conduit is equal to approximately 0.75 inches and the diameter of said second outlet conduit is equal to approximately 0.75 inches.

6. The pressure tank apparatus according to claim 4, wherein said inlet conduit has a diameter equal to approximately 0.25 inches to approximately 2.25 inches.

7. The pressure tank apparatus according to claim 6, wherein the diameter of said inlet conduit is equal to approximately 0.75 inches.

8. The pressure tank apparatus according to claim 1, wherein said first outlet conduit, said second outlet conduit and said inlet conduit are galvanized piping.

9. The pressure tank apparatus according to claim 1, wherein said first outlet conduit, said second outlet conduit and said inlet conduit are stainless steel piping.

10. The pressure tank apparatus according to claim 1, wherein said liquid storage vessel is constructed from polyvinylchloride.

11. A pressure tank apparatus having a longitudinal axis, comprising:

a liquid storage vessel, wherein said liquid storage vessel comprises:

a first end;

a second end that opposes said first end; and a first side wall that extends between said first and second ends;

a second side wall that opposes said first side wall and extends between said first and second ends;

a first end wall that extends between said first and second ends; and a second end wall that opposes said first end wall and extends between said first and second ends wherein the side walls and end wall form the storage vessel;

an inlet conduit connected to said liquid storage vessel;

a first outlet conduit connected to said liquid storage vessel;

a second outlet conduit connected to said liquid storage vessel and passing through a center of said second end, the second outlet conduit extending along said longitudinal axis to about a midpoint of said longitudinal axis;

an air control valve passing through said first side wall and disposed between said first outlet conduit and said second outlet conduit, wherein said air control valve releases air from said inner chamber in response a pressure in said inner chamber exceeding a predetermined maximum pressure threshold;

a valve cap connected to said liquid vessel;

a compressed air source connected to said valve cap to supply compressed air to said inner chamber;

a first cut-off valve connected to said inlet conduit, wherein said first cut-off valve controls the liquid flow into said inner chamber; and a second cut-off valve connected to said first outlet conduit, wherein said second cut-off valve controls the flow of liquid out of said inner chamber;

a pump connected to said inlet conduit, wherein said pump pumps liquid into said inner chamber under pressure via said inlet in response to being activated; and an air pressure switch configured to sense a pressure in said inner chamber, wherein said air pressure switch is configured to activate the pump in response to the sensed pressure being less than a pre-determined minimum pressure threshold and wherein said air pressure switch is configured to deactivate said pump in response to said sensed pressure exceeding a working pressure threshold.

12. The pressure tank apparatus according to claim 11, further comprising:

an air pressure gauge.

13. A water pressure system, comprising:

a pressure tank apparatus, wherein said pressure tank comprises:

a liquid storage vessel, wherein said liquid storage vessel comprises:

a first end;

a second end that opposes said first end; and a curved side wall that extends between said first end and said second end, wherein said curved side wall encircles the longitudinal axis to define an inner chamber;

an inlet conduit connected to said liquid storage vessel and said pump;

a first outlet conduit connected to said liquid storage vessel;

a second outlet conduit connected to said liquid storage vessel and passing through a center of said second end, the second outlet conduit extending along said longitudinal axis to about a midpoint of said longitudinal axis;

an air control valve passing through said curved side wall and disposed between said first outlet conduit and said second outlet conduit, wherein said air control valve releases air from said inner chamber in response a pressure in said inner chamber exceeding a predetermined maximum pressure threshold;

a valve cap connected to said liquid vessel;

a compressed air source connected to said valve cap to supply compressed air to said inner chamber;

a first cut-off valve connected to said inlet conduit, wherein said first cut-off valve controls the liquid flow into said inner chamber; and a second cut-off valve connected to said first outlet conduit, wherein said second cut-off valve controls the flow of liquid out of said inner chamber;

a pump that pumps liquid into said inner chamber under pressure; and an air pressure switch configured to sense a pressure in said inner chamber, wherein said air pressure switch is configured to activate the pump in response to the sensed pressure being less than a pre-determined minimum pressure threshold and wherein said air pressure switch is configured to deactivate said pump in response to said sensed pressure exceeding a working pressure threshold.

14. The water pressure system according to claim 13, further comprising:

an air pressure gauge.

15. The water pressure system according to claim 13, wherein said first outlet conduit is connected said curved side wall and wherein said second outlet conduit to said first end.

16. The water pressure system according to claim 13, wherein said first outlet conduit has a diameter equal to approximately 0.25 inches to approximately 2.25 inches and a length equal to approximately 21 inches and wherein said second outlet conduit has a diameter has a equal to approximately 0.25 inches to approximately 2.25 inches and a length equal to approximately 10 inches.

17. The water pressure system according to claim 16, wherein the diameter of said first outlet conduit is equal to approximately 0.75 inches and the diameter of said second outlet conduit is equal to approximately 0.75 inches.

18. The water pressure system according to claim 17, wherein said inlet conduit has a diameter equal to approximately 0.25 inches to approximately 2.25 inches.

19. The water pressure system according to claim 18, wherein the diameter of said inlet conduit is equal to approximately 0.75 inches.

20. A method for pressurizing a liquid, comprising:

pumping a liquid into a pressure tank apparatus, wherein the tank apparatus comprises:

a liquid storage vessel, wherein the liquid storage vessel comprises:

a first end;

a second end that opposes the first end; and a curved side wall that extends between the first end and the second end, wherein the curved side wall encircles the longitudinal axis to define an inner chamber;

an inlet conduit connected to the liquid storage vessel;

an outlet conduit connected to the liquid storage vessel;

a second outlet conduit connected to said liquid storage vessel and passing through a center of said second end, the second outlet conduit extending along said longitudinal axis to about a midpoint of said longitudinal axis;

an air control valve passing through said curved side wall and disposed between said first outlet conduit and said second outlet conduit, wherein said air control valve releases air from said inner chamber in response a pressure in said inner chamber exceeding a predetermined maximum pressure threshold;

a valve cap connected the liquid vessel;

a first cut-off valve connected to the inlet conduit, wherein the first cut-off valve controls the liquid flow into the inner chamber; and a second cut-off valve connected to the first outlet conduit, wherein the second cut-off valve controls the flow of liquid out of the inner chamber;

compressing a quantity of air retained within the vessel;

generating a pressure equilibrium between the water and the quantity of air within the vessel, using a compressed air source connected to said valve cap to supply compressed air to said inner chamber, and using a pump that pumps liquid into said inner chamber under pressure; and an air pressure switch configured to sense a pressure in said inner chamber, wherein said air pressure switch is configured to activate the pump in response to the sensed pressure being less than a pre-determined minimum pressure threshold and wherein said air pressure switch is configured to deactivate said pump in response to said sensed pressure exceeding a working pressure threshold.

21. The method according to claim 20, further comprising releasing the liquid from the pressure tank apparatus via the outlet conduit.

22. The method according to claim 20, wherein the diameter of the outlet conduit is equal to approximately 0.75 inches and the diameter of the inlet conduit is equal to approximately 0.75 inches.

23. A pressure tank apparatus, comprising:

means for pumping a liquid into a pressure tank apparatus, wherein the tank apparatus comprises:

a liquid storage vessel, wherein the liquid storage vessel comprises:

a first end;

a second end that opposes the first end; and a curved side wall that extends between the first end and the second end, wherein the curved side wall encircles the longitudinal axis to define an inner chamber;

an inlet conduit connected to the liquid storage vessel;

an outlet conduit connected to the liquid storage vessel;

a second outlet conduit connected to said liquid storage vessel and passing through a center of said second end, the second outlet conduit extending along said longitudinal axis to about a midpoint of said longitudinal axis;

an air control valve passing through said curved side wall and disposed between said first outlet conduit and said second outlet conduit, wherein said air control valve releases air from said inner chamber in response a pressure in said inner chamber exceeding a predetermined maximum pressure threshold;

a valve cap connected the liquid vessel;

a first cut-off valve connected to the inlet conduit, wherein the first cut-off valve controls the liquid flow into the inner chamber; and a second cut-off valve connected to the first outlet conduit, wherein the second cut-off valve controls the flow of liquid out of the inner chamber;

means for generating a pressure equilibrium between the water and the quantity of air within the vessel said generating means comprising a compressed air source connected to said valve cap to supply compressed air to said inner chamber, and a pump that pumps liquid into said inner chamber under pressure; and an air pressure switch configured to sense a pressure in said inner chamber, wherein said air pressure switch is configured to activate the pump in response to the sensed pressure being less than a pre-determined minimum pressure threshold and wherein said air pressure switch is configured to deactivate said pump in response to said sensed pressure exceeding a working pressure threshold.

* * * * *